US005581327A

United States Patent [19]

Izumizaki et al.

[11] Patent Number: 5,581,327

[45] Date of Patent: Dec. 3, 1996

[54] IMAGE FORMING APPARATUS

[75] Inventors: Masami Izumizaki; Shigeru Oki, both of Yokohama, Japan

[73] Assignee: Canon Kabushiki Kaisha, Tokyo, Japan

[21] Appl. No.: 363,892

[22] Filed: Dec. 27, 1994

[30] Foreign Application Priority Data

Dec. 28, 1993 [JP] Japan ..... 5-349346
Dec. 22, 1994 [JP] Japan ..... 6-320040

[51] Int. Cl.[6] ..... G03G 21/00

[52] U.S. Cl. ..... 355/208; 355/246; 355/326 R; 355/327

[58] Field of Search ..... 355/246, 208, 355/326 R, 327, 328, 271–273, 277, 245, 203, 204

[56] References Cited

U.S. PATENT DOCUMENTS 5,294,959 3/1994 Nagao et al. ..... 355/208
5,307,119 4/1994 Folkins et al. ..... 355/208
5,376,956 12/1994 Nagao et al. ..... 355/208

FOREIGN PATENT DOCUMENTS 0519710 12/1992 European Pat. Off. .
61-158348 7/1986 Japan ..... 355/326 A
3-288173 12/1991 Japan ..... 355/326 A
4-149469 5/1992 Japan ..... 355/327

*Primary Examiner*—Matthew S. Smith
*Attorney, Agent, or Firm*—Fitzpatrick, Cella, Harper & Scinto

[57] ABSTRACT

This invention relates to an image forming apparatus having a plurality of image bearing members including a first image bearing member and a second image bearing member, a transferring material bearing member for bearing the transferring material to respective transfer positions of the plurality of image bearing members, detecting a detecting device for detecting the density of a toner patch formed on the second image bearing member after the toner patch has passed the transfer position of the second image bearing member. The orientation of the image bearing members are such that the time from when the first image bearing member and the transferring material bearing member are detached from each other to when the toner patch reaches the transfer position of the second image bearing member is larger than L/V (sec) where L (mm) is the distance between the first image bearing member and the second image bearing member in a direction of movement of the transferring material bearing member and V (mm/sec) is the speed of the transferring material bearing member.

10 Claims, 3 Drawing Sheets

IMAGE FORMING APPARATUS

BACKGROUND OF THE INVENTION

1. Field of the Invention

The present invention relates to an image forming apparatus such as an electrophotographic apparatus and an electrostatic recording apparatus, and more particularly to an image forming apparatus for forming an image on a transferring material being born by a transferring material bearing member.

2. Related Background Art

There is a known image forming apparatus for forming a full color image in which a toner image is formed on a photosensitive drum as a single image bearing member and transferred to a transferring material being born by a transfer drum as a transferring material transporting member. In the apparatus, when toner in a developing unit for forming the toner image decreases, it is necessary to replenish it depending on the decreased amount of toner. For this purpose, there is a known method in which a toner patch is formed on the photosensitive drum by means of the developing unit and the toner in the developing unit is replenished based on the density of the toner patch to keep the toner in the developing unit to be a predetermined amount.

For example, EP-A-519710 discloses that a sensor for detecting the density of a toner patch is provided in a direction of moving a photosensitive drum on the downstream side of a transfer position and on the upstream side of a cleaning position. With this structure, the sensor is prevented from being soiled by toner scattered from the developing unit. Also, EP-A-519710 discloses that when the toner patch passes the transfer position such that it is not conveyed to the surface of a transfer drum, the pressing of a pressing member for pressing a transferring material bearing sheet of a transfer drum toward the photosensitive drum is released.

Further, there is an image forming apparatus in which in order to form a full color image at high speed, a plurality of photoreceptors for respective colors, i.e., four photoreceptors for respective cyan, magenta, yellow and black are provided and toner images of respective colors are transferred to a transferring material being born by a transfer belt as a transferring material bearing member. In this apparatus, for example, when detecting a toner patch formed on the photoreceptor for black toner in the same manner as in EP-A-519710, the following problem occurs even though the transfer belt is detached from the photoreceptors while the toner patch is passing the transfer position.

That is, when the pressing of pressing members for pressing the transfer belt is released, the transfer belt is vibrated due to the release operations of the pressing members in the respective magenta, cyan and yellow stations and the vibration reaches the black station located downstream as the transfer belt moves. As a result, in the downstream black station, the toner patch is brought into contact with the vibrating transfer belt, so that the toner patch cannot be detected accurately.

SUMMARY OF THE INVENTION

It is an object of the present invention to provide an image forming apparatus in which a toner patch is prevented from being brought into contact with a transferring material bearing member at a transfer position.

It is another object of the present invention to provide an image forming apparatus in which distortion of a toner patch is prevented and the density of the toner patch can be detected accurately.

It is still another object of the present invention to provide an image forming apparatus in which after the vibration level of a transferring material bearing member is lowered, a toner patch is made to pass a transfer position.

The above and other objects and advantages of the present invention will be apparent from the following detailed description of the preferred embodiments when read in connection with the following drawings.

DETAILED DESCRIPTION OF THE PREFERRED EMBODIMENTS

An image forming apparatus according to an embodiment of the present invention will be described with reference to the accompanying drawings.

Figure 1:
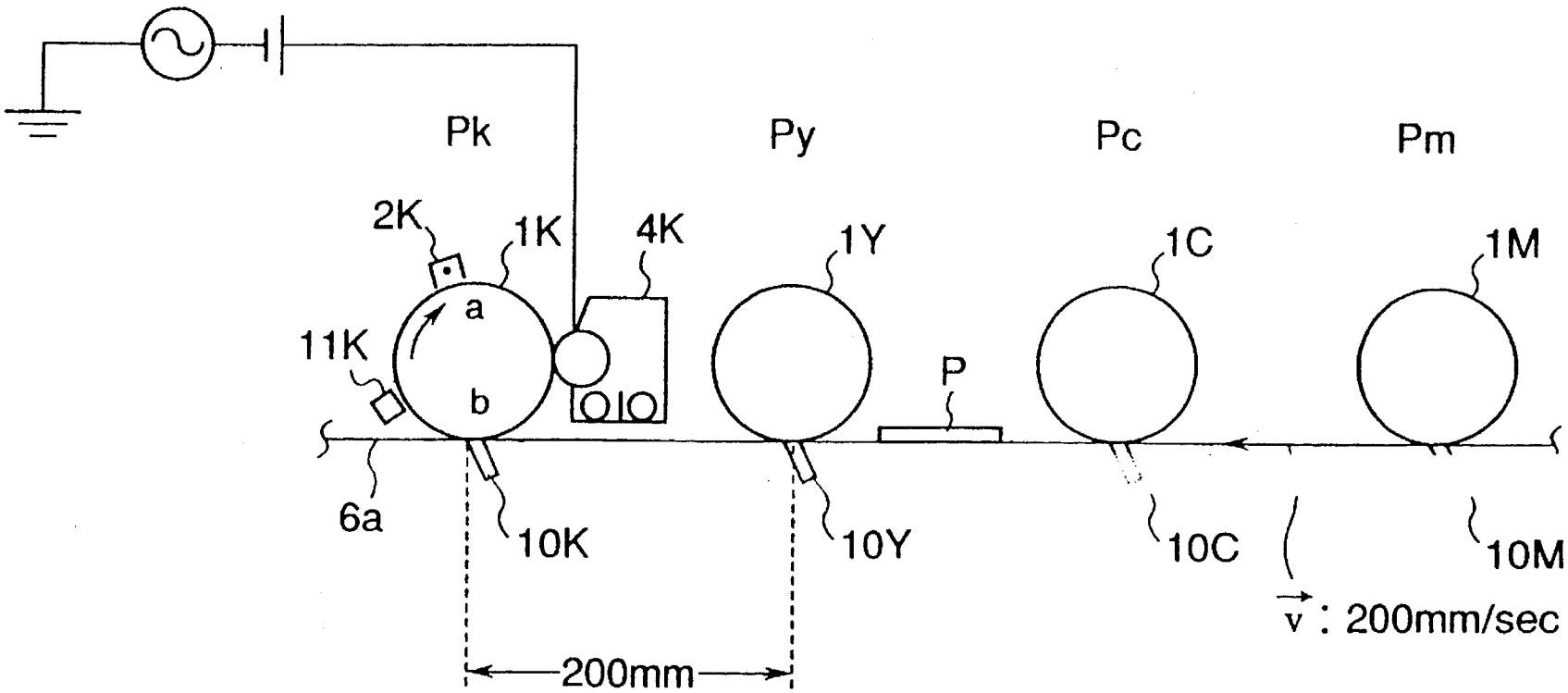
FIG. 1 is a schematic diagram showing an essential portion of an image forming apparatus according to the present invention.

FIG. 1 shows a portion of the image forming apparatus of the present invention.

Figure 2:
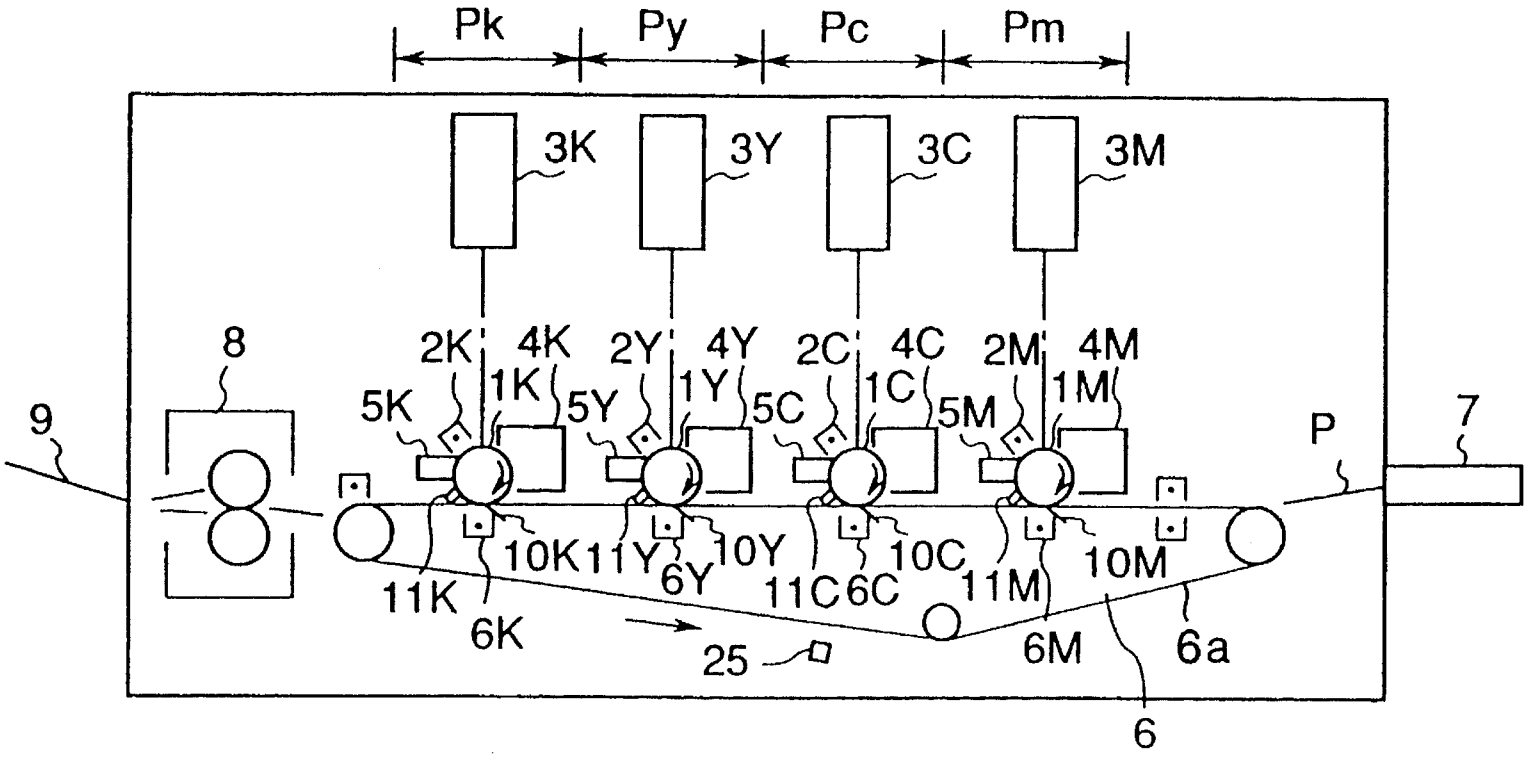
FIG. 2 is a schematic diagram showing the whole structure of the image forming apparatus.

FIG. 2 shows the whole structure of a full color laser beam printer 9 as the image forming apparatus wherein the like elements of FIGS. 1 and 2 are labelled in a consistent manner.

The laser beam printer 9 has light scanning means by the use of a plurality of laser beams and four photosensitive drums 1M, 1C, 1Y and 1K. This printer is provided with four color image forming stations formed by disposing image forming means around respective electrophotographic photoreceptors. Toner images formed on the respective photosensitive drums in the image forming stations are transferred to a transferring material P being transported by a transfer belt *6a* as transferring material bearing means which are moved in opposition to the photosensitive drums.

The photosensitive drums 1M, 1C, 1Y and 1K as image bearing members are disposed in the magenta, cyan, yellow and black image forming stations Pm, Pc, Py and Pk, and rotated in directions indicated by arrows in the drawing (clockwise direction). Also, around the respective photosensitive drums 1M, 1C, 1Y and 1K are disposed the image forming means having primary (corona) electrifiers 2M, 2C, 2Y and 2K as latent image forming means, scanning optical units 3M, 3C, 3Y and 3K as the light scanning means, developing units 4M, 4C, 4Y and 4K as developing means, and cleaning units 5M, 5C, 5Y and 5K.

Further, a transfer section 6 constituting the image forming means has the transfer belt *6a* commonly used for the image forming stations and transfer chargers 6M, 6C, 6Y and 6K as transferring means for the drums. A full color image is formed by transferring toner images of the respective colors formed on the photosensitive drums successively to the transferring material P being supported by the transfer belt *6a* and transported in a predetermined direction. Also, in order to obtain nip pressure between the photosensitive drums and the belt *6a*, polyethylene telephthalate sheet-like backup pressing members 10M, 10C, 10Y and 10K are provided below the respective photosensitive drums 1M, 1C, 1Y and 1K so as to be able to push up the back surface of the transfer belt 6*a*. Owing to the on-off control of the backup members 10M, 10C, 10Y and 10K, the photosensitive drums and the transfer belt are brought into contact with each other or detached from each other. The backup members are controlled by solenoids (not shown).

Also, density sensors 11M, 11C, 11Y and 11K as density detecting means for reading the densities of the toner images on the respective photosensitive drums are provided in the respective image forming stations. The density sensor 11M is disposed on the opposite side of the developing unit 4M via the transfer belt 6*a*, i.e., in the direction of moving the photosensitive drum 1M on the downstream side of a transfer position and on the upstream side of a developing position so as to avoid toner scattered from the developing unit 4M. The density sensors 11C, 11Y and 11K are disposed in the same manner as the density sensor 11M. The transferring material P is supplied from a cassette 7. When the transfer process has been completed, the transferring material P is ejected to a tray 9 via fixing unit 8.

In each of the developing unit of the above full color image forming apparatus, it is preferable to utilize a two component developer consisting of toner and carrier from the standpoint of tone of the image. As well known, the toner density of the two component developer is a very important factor to stabilize the image quality.

As the development proceeds, the toner of the developer decreases and the toner density changes. Therefore, it is necessary to detect the toner density of the developer by the use of a developer density control device accurately and to replenish the toner in the developing unit in accordance with the density change thereby to keep the toner density constant and to maintain the image quality preferably. That is, it is desirable to keep the amount of toner in the developing unit always constant.

Now, the developer density control of the image forming apparatus will be described, taking the Pk station as example. First, the surface of the photosensitive drum 1K is charged by the primary electrifier 2K uniformly. Thereafter, the surface of the photosensitive drum 1 is scanned and exposed by the scanning optical unit 3K modulated in accordance with an image information signal corresponding to a predetermined reference density patch, whereby a static latent image corresponding to the reference density patch is formed on the photosensitive drum 1. Next, the static latent image on the photosensitive drum 1 is developed by the developing unit 4K using the two component developer of the mixture of the toner and carrier. As a result, the static latent image becomes a reference toner image. If the photosensitive drum 1K were left to be in contact with the transfer belt 6*a*, the reference toner image on the photosensitive drum 1K would be in contact with the transfer belt 6*a* and distorted. Then, before the reference toner image passes the transfer position, the backup member 10K is switched off to detach the transfer belt 6*a* from the photosensitive drum 1K thereby to provide about a 1 mm space between the transfer belt 6*a* and the photosensitive drum 1K. Then, the reference toner image is made to pass the 1 mm space. After the reference toner image has passed the transfer section, its density is read by the density sensor 11K.

Figure 3:
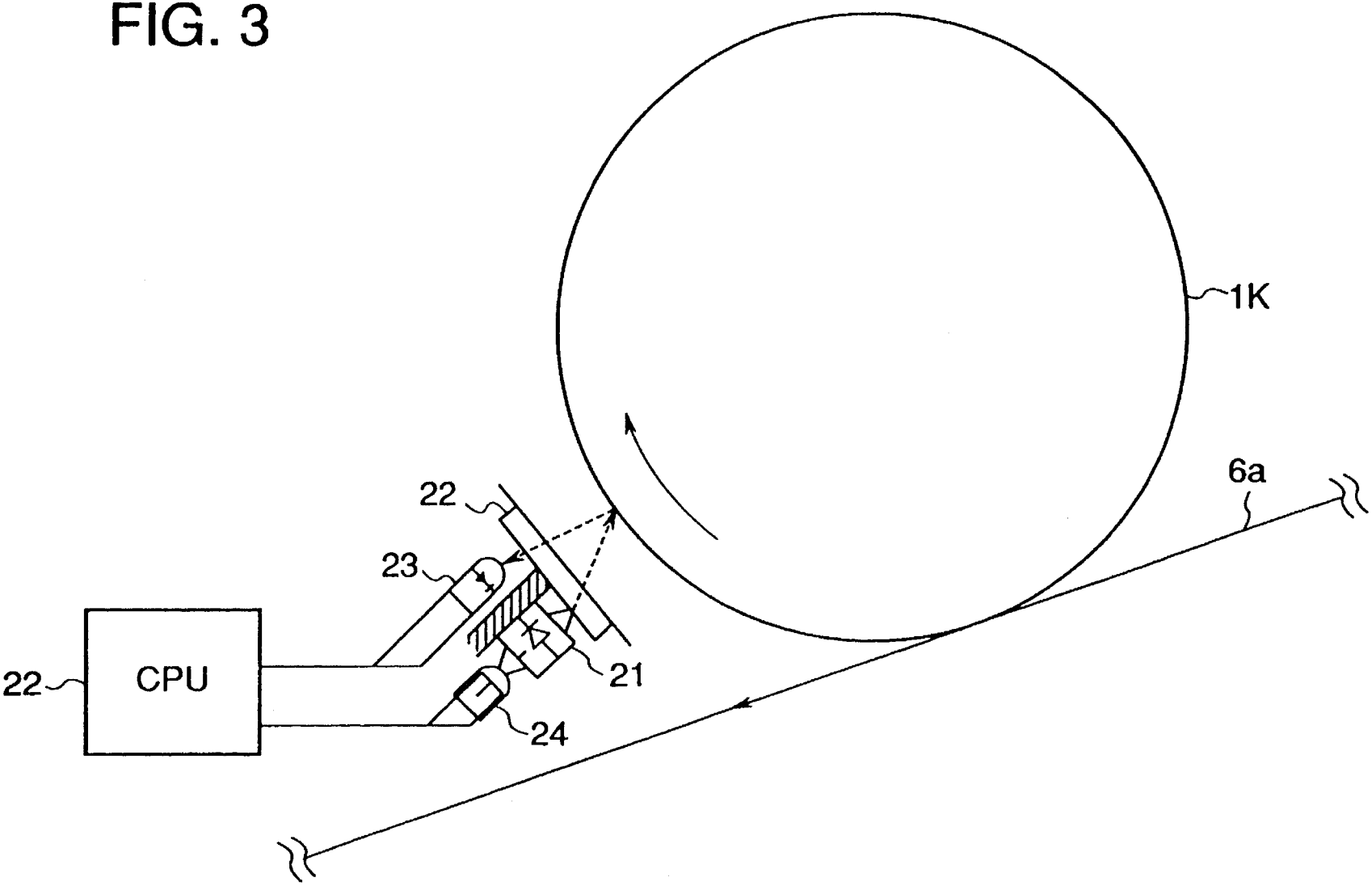
FIG. 3 is a schematic diagram showing the density sensor of the image forming apparatus.

As shown in FIG. 3, the density sensor 11K has a light emitting device 21, an optically transparent window 22, a light receiving device 23 and a light receiving device 24 for monitoring direct light from the light emitting device 21. The density of the reference toner image is read by the density sensor 11K and the read value $v_1$ is compared with a preset initial value $v_0$ in a CPU 22. As a result, the toner of the developing unit is replenished when necessary, whereby the image density is kept constant.

However, in the Pk station located downstream, when the backup member 10K is switched off to detach the transfer belt 6*a* from the photosensitive drum 1K and the reference toner image is made to pass between the space between the photosensitive drum 1K and the transfer belt 6*a*, the following problem occurs, as mentioned above.

When the backup members 10M, 10C, and 10Y of the upstream M, C and Y stations are switched off, the transfer belt 6*a* is vibrated with the equilibrium position as the center within a certain amplitude. The vibration is transmitted to the downstream station as the transfer belt 6*a* moves. As a result, depending on its timing, the reference toner image is brought into contact with the vibrating transfer belt 6*a* to be distorted, whereby stable developer density control cannot be performed.

In order to solve this problem, the black toner patch is formed on the photoreceptor in the black station in such timing that the black toner patch passes the transfer position of the black station after the backup members were detached from the transfer belt and a greatest vibration wave has passed the black station.

In particular, after the transferring material P has passed the final black station Pk, the backup members 10M, 10C, 10Y and 10K are detached from the transfer belt 6*a* simultaneously so as to detach the transfer belt 6*a* from the photosensitive drums. At this time, the time at which the backup members 10M, 10C, 10Y and 10K are detached from the transfer belt 6*a* is 0 sec (start). As shown in FIG. 1, as the distance between adjacent transfer position is 200 mm, the distance between the transfer position of the black station and the transfer position of the magenta station is 200×3=600 mm.

When the backup members are detached from the transfer belt 6*a*, the tension of the transfer belt 6*a* is reduced and the transfer belt 6*a* starts vibrating from points at which the backup members 10M, 10C, 10Y and 10K was in contact with the photosensitive drum 1M, 1C, 1Y and 1K via the transfer belt 6*a*. This vibration wave is transmitted at a transfer belt advancing speed of 200 mm/sec and it takes 600/200=3 sec until a vibration wave generated in the most upstream magenta station Pm reaches the most downstream black station Pk. The reference black toner patch starts to be formed so as to become timing that the reference black toner patch reaches the transfer position of the black station after this vibration wave from the magenta station Pm has passed the black station Pk. It is to be noted that a largest vibration wave is generated at the moment when the backup members are detached from the transfer belt and thereafter small vibration waves are generated. However, the small vibration waves do not have an amplitude which causes the black toner patch to be distorted. Also, after passing the black station, the largest vibration wave damps at a position of a roller supporting the transfer belt.

More specifically, a reference image signal generating circuit for generating a reference image signal having a signal level corresponding to a predetermined density is provided. The reference image signal from the generating circuit is supplied to a pulse width modulating circuit which generates a laser drive pulse having a pulse width corresponding to the predetermined density. The laser drive pulse is sent to the scanning optical unit 3K such as a semiconductor laser, which then emits light for the time corresponding to the pulse width of the laser drive pulse so as to scan the photosensitive drum 1K. Thereby, a reference static latent image corresponding to the predetermined density is formed on the photosensitive drum 1K. Thereafter, the reference static latent image is developed by the developing unit 4K. The resultant patch-like reference toner image is read by the density sensor 11K consisting of a LED and a photoelectric transfer device thereby to be an output signal. This output signal corresponds to the density of the reference toner image, and eventually corresponds to the actual toner density of the two component developer in the developing unit 4K, i.e., the amount of toner in the developing unit 4K.

The output signal of the photoelectric transfer device is supplied to one input of a comparator. To the other input of the comparator is supplied a reference signal corresponding to a prescribed toner density (the toner density of the initial set value) of the developer from a reference voltage signal source. Namely, the comparator compares the prescribed toner density with the actual toner density in the developing unit. As the result of the comparison of both input signals, the comparator generates an output signal indicating that the actual toner density of the developer in the developing unit 4K is higher than the prescribed value or an output signal indicating that the toner density is lower than the prescribed value. Also, when there is no difference between both input signals, an output signal indicating it may be generated. The output signal from the comparator is supplied to the CPU.

The reference toner image passes through the space between the transfer belt 6*a* and the photosensitive drum 1K until it reaches the density sensor 11K. Also, the reference toner image passes through the space after the vibration wave generated in the most upstream magenta station Pm has passed the black station.

Next, a case in which a three color image is formed on a transferring material by the use of the three color image forming stations excluding the magenta station will be described. In the image forming apparatus of FIG. 2, a single color mode, two color mode or three color mode (arbitrarily selected colors) other than the above-mentioned four color mode for forming a four color image on the transferring material P can be specified by operating an operating panel. Therefore, when the three color mode of cyan, yellow and black is specified, a three color image of cyan, yellow and black is formed on a transferring material. At this time, the most upstream magenta station is not utilized and when forming the three color image, the backup member 10M is switched off. Therefore, at the time of the image formation, among the stations in which the backup members are made to be in the on-state, the cyan station Pc is the most upstream station and the timing of a reference toner image formation and a density detection in the black station is controlled in accordance with the on-off operation of the backup member 10C of the cyan station Pc. That is, after a vibration wave generated in the most upstream cyan station Pc has passed the black station Pk, a black reference toner image passes the transfer position of the black station Pk. Since the distance between the cyan station and the black station is 200×2=400 (mm) and the speed of the transfer belt 6*a* is 200 (mm/sec), the time from when the backup member of the cyan station Pc is switched from on to off to when the black toner patch reaches the transfer position of the black station Pk is made longer than 400/200=2 (sec).

Also, in the above embodiments, the switching of the backup members of the respective stations from on to off is performed simultaneously, but each backup member may be switched from on to off after the transferring material has passed corresponding one of the transfer positions of the respective stations. That is, in the case of a four color image formation, the backup members are switched from on to off successively in order of the magenta, cyan, yellow and black stations. In particular, it is desirable to switch each backup member from on to off as soon as the trailing end of the transferring material has passed corresponding one of the transfer positions of the stations. Also, in such a case, the black toner patch is formed in accordance with the off-timing of the backup member located most upstream.

Also, in the above embodiments, although all the backup members are detached from the transfer belt when detecting the black toner patch, the purpose of this is to detach the transfer belt 6*a* from the photosensitive drum 1K of the black station completely. Further, when detaching the transfer belt 6*a* from the photosensitive drum 1K, it is preferable to detach the backup members from the transfer belt 6*a* without moving a plurality of rollers supporting the transfer belt 6*a* downward, i.e., with the distance between the plurality of rollers and the photosensitive drums kept constant.

Also, instead of the transfer chargers 6M, 6C, 6Y and 6K and the backup members 10M, 10C, 10Y and 10K, transfer blades may be provided so as to be in contact with the back surface of the transfer belt 6*a* at the respective transfer positions. In this case, transfer voltage is applied to each transfer blade. When detaching the transfer belt 6*a* from the photosensitive drums of the respective stations, the transfer blades are detached from the transfer belt 6*a* instead of detaching the backup members 10M, 10C, 10Y and 10K from the transfer belt 6*a*. The timing of detaching the transfer blades from the transfer belt 6*a* is the same as the timing of detaching the backup members from the transfer belt 6*a*, as mentioned above.

Furthermore, the image forming apparatus of FIG. 2 is provided with the four image forming stations, but the present invention can be applied to an image forming apparatus having only two image forming stations.

In the above embodiments, the transfer belt 6*a* has a seam. Then, when the transferring material is placed on the seam portion, preferable transfer cannot be achieved. So, the transferring material is placed on the transfer belt 6*a* other than the same portion. Accordingly, when starting image formation, the position of the seam is checked by a seam detecting device 25 as shown in FIG. 2. After having finished the image formation, in preparation for the following image formation, it is preferable to stop the transfer belt 6*a* when its seam portion reaches the detecting position of the sensor 25. Also, when detecting the black toner patch after the completion of transfer, it is preferable to move the transfer belt 6*a* until the seam is detected by the sensor 25.

The present invention is not limited to the above-described embodiments and various modifications can be taken within the scope and spirit of the invention.

What is claimed is:

1. An image forming apparatus comprising:

a plurality of image bearing members including a first image bearing member and a second image bearing member provided on the downstream side of said first image bearing member in a direction of moving a transferring material;

a transferring material bearing member for bearing said transferring material to respective transfer positions of said plurality of image bearing members, respective toner images being transferred from said plurality of image bearing members to said transferring material being born by said transferring material bearing member; and detecting means for detecting the density of a toner patch formed on said second image bearing member after said toner patch has passed said transfer position of said second image bearing member, said transferring material bearing member being detached from said plurality of image bearing members when detecting said toner patch by said detecting means;

wherein defining the distance between said first image bearing member and said second image bearing member in a direction of moving said transferring material bearing member is L (mm) and the speed of said transferring material bearing member is V (mm/sec), the time from when said first image bearing member and said transferring material bearing member are detached from each other to when said toner patch reaches said transfer position of said second image bearing member is longer than L/V (sec).

2. An image forming apparatus according to claim 1, further comprising pressing members for pressing said transferring material bearing member toward said plurality of image bearing members at said respective transfer positions of said image bearing members, said pressing members being detached from said transferring material bearing member when detecting said toner patch.

3. An image forming apparatus according to claim 2, further comprising a plurality of rotatable members for supporting said transferring material bearing member, the positional relationship of said plurality of image bearing members and said plurality of rotatable members being constant both at the time of transferring said toner images on said transferring material and at the time of detecting said toner patch.

4. An image forming apparatus according to claim 2, wherein said pressing members are detached from said transferring material bearing member simultaneously when detecting said toner patch.

5. An image forming apparatus according to claim 1, further comprising a developing unit for developing said second image bearing member with toner, an amount of toner supplied to said developing unit being controlled based on the density of said toner patch detected by said detecting means.

6. An image forming apparatus according to claim 5, wherein said developing unit includes said toner and carrier.

7. An image forming apparatus according to claim 1, wherein said first image bearing member is positioned farther away from said second image bearing member among said plurality of image bearing members in the direction of moving said transferring material.

8. An image forming apparatus according to claim 1, wherein said toner patch is black.

9. An image forming apparatus according to claim 1, wherein a full color image can be formed on said transferring material.

10. An image forming apparatus according to claim 1, wherein said transferring material bearing member is in the shape of a belt.

* * * * *